United States Patent [19]

Grass

[11] Patent Number: 4,675,941

[45] Date of Patent: Jun. 30, 1987

[54] SINGLE-JOINT DOOR HINGE WITH SPRING-LOADED CLOSING PRESSURE AND OPTIONALLY OPENING PRESSURE DEVICE

[76] Inventor: Alfred Grass, Konsumstrasse 20, A-6973 Hochst, Austria

[21] Appl. No.: 815,762

[22] Filed: Jan. 2, 1986

Related U.S. Application Data

[63] Continuation of Ser. No. 494,632, May 16, 1983, abandoned.

[30] Foreign Application Priority Data

May 18, 1982 [DE] Fed. Rep. of Germany ..... 3218804

[51] Int. Cl.[4] ..... E05D 11/10

[52] U.S. Cl. ..... 16/295; 16/332

[58] Field of Search ..... 16/228, 286, 291, 292, 16/297, 305, 327, 331, 332, 335, 341, DIG. 36, 295

[56] References Cited

U.S. PATENT DOCUMENTS

| | | | |
|---|---|---|---|
| 2,940,116 | 6/1960 | Salice | 16/291 |
| 3,381,332 | 5/1968 | Jerila et al. | 16/327 |
| 3,728,757 | 4/1973 | Lloyd | 16/332 X |
| 3,835,585 | 9/1974 | Anderson et al. | 16/335 X |
| 4,400,848 | 8/1983 | Grass | 16/332 |

FOREIGN PATENT DOCUMENTS

| | | | |
|---|---|---|---|
| 628889 | 3/1963 | Belgium | 16/291 |
| 2337224 | 2/1975 | Fed. Rep. of Germany | 16/291 |
| 1185318 | 3/1970 | United Kingdom | 16/335 |

*Primary Examiner*—Fred Silverberg

*Attorney, Agent, or Firm*—Lackenbach, Siegel, Marzullo & Aronson

[57] ABSTRACT

A single-joint door hinge with closing pressure and optionally with opening pressure device consists of a hinge pan having an inner recess, in the opposite sidewalls of which seatings for an axle are formed which is embraced by the bend ends of a hinge arm. The outer face of the bent end of the hinge arm is formed as a cam for a roller present under the force of two springs. Each spring is supported by its spring turns on a pin on the hinge pan and applies by its one end against the external wall of the hinge pan and embraces by the other bent leg end one side of the roller.

1 Claim, 7 Drawing Figures

SINGLE-JOINT DOOR HINGE WITH SPRING-LOADED CLOSING PRESSURE AND OPTIONALLY OPENING PRESSURE DEVICE

This application is a continuation of application Ser. No. 494,632, filed May 16, 1983, now abandoned.

A door hinge has become known for example with the subject matter of U.S. Pat. No. 3,381,332 or of U.S. Pat. No. 3,577,840.

These known arrangements use so-called hairpin springs, where the spring which is to provide the closing pressure and optionally an opening pressure is bent in a small radius. Due to this the spring may break easily, and high closing pressures and optionally opening pressure cannot be obtained.

Proceeding from a single-joint door hinge of the above named kind, the invention substantially improves the spring force of known single joint door hinges and also lengthens the life of the spring used for them.

To solve the problem posed, the invention is characterized in that as bending spring two separate springs are provided, of which each spring takes its support at one end fixed on the external wall of the hinge pan and engages at the other end about an roller element, ending with a bent end around one side of the roller element, and the spring turns of the two separate springs are supported on a larger pin element which is connected with the hinge pan.

It is, therefore, an essential feature of the present invention that in lieu of sharply bent springs two uniformly curved springs of several spring turns are used.

Such springs create a high spring force while at the same time the danger of breaking is low, for on the basis of the uniformly and rotation-symmetrically laid spring turns, such a spring also exhibits outstanding performance and long life.

Small radii of curvature and sharply bent points of the spring are avoided. Besides, such spring configuration offers the advantage that they are easy to install in the hinge housing and hence are also easy to exchange.

Each spring embraces by its bent end the roller axle of the roller which under spring load applies against the cam of the hinge arm. The cam is defined by the outer face of the bent end of the hinge arm, which is rotatably mounted on an axle secured in the hinge pan and embraces this axle by its bent end. The outer face of this bent end acts as a cam, because the roller applies against this outer face under the force of the two springs which are employed in the door hinge at opposite ends of the housing. Hence a strong spring force is created by the roller acting on this control face. In the closing position of the single-joint hinge, the spring-loaded roller snaps into an opening of the cam, so that under the force of these two springs the hinge is kept closed in the closing position under a spring-loaded condition.

In analogous manner also the opening position of the hinge can be kept open under spring-loaded condition under the force of the springs. Also for this purpose it is then intended to provide a corresponding opening in the cam of the bent end of the hinge arm, so that the spring-loaded roller engages in such an opening also which in the opening position so as to provide a lock in the opening position.

The single-joint door hinge according to the invention is used preferably for doors of kitchen fronts (front panels), of furniture fronts and the like, the hinge pan being secured in a recess in the inside of the door, and the hinge arm on the inside of a body sidewall. With the closing pressure and opening pressure device according to the invention, the door is then kept in the closing position under the force of the two springs. During the opening process, the spring-loaded roller disengages from the opening in the cam associated with the closing pressure position and rolls off on a circular section of the bent end of the hinge arm, so that after the overcoming of the closing pressure of the device, only a very small force is required for carrying out the opening movement.

It should be noted that when the opening position is reached, the spring-loaded roller again snaps into a corresponding opening in the cam of the bent end of the hinge arm, so that also the opening position is spring-loaded.

The subject of invention of the present invention is evident not only from the subject of the individual claims, but also from the combination of the individual claims with one another.

All data and features disclosed in the documents, in particular the spatial realization illustrated in the drawings, are claimed as essential to the invention, insofar as they singly or in combination are novel relative to the state of the art.

In the following, the invention will be explained more specifically with reference to drawings representing only a mode of execution. Further features essential to the invention and the advantages of the invention will be evident from these drawings and their following description.

Figure 1:
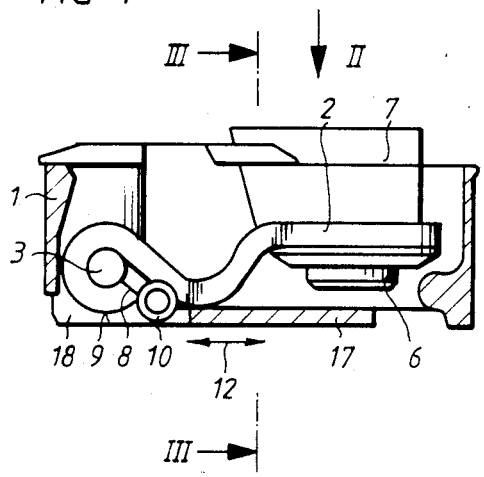
FIG. 1 is a sectional view through a hinge according to the invention.
Figure 2:
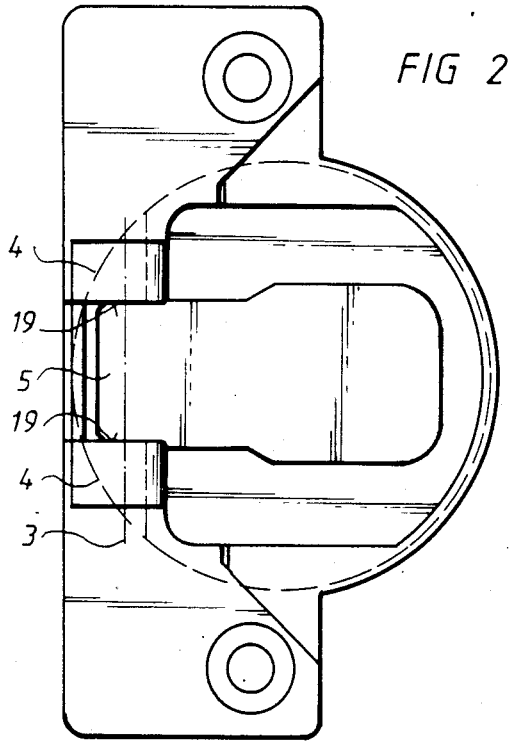
FIG. 2 is a top plan view onto the hinge pan in the direction of the arrow II shown in FIG. 1, but omitting the closing pressure device and the hinge arm.
Figure 3:
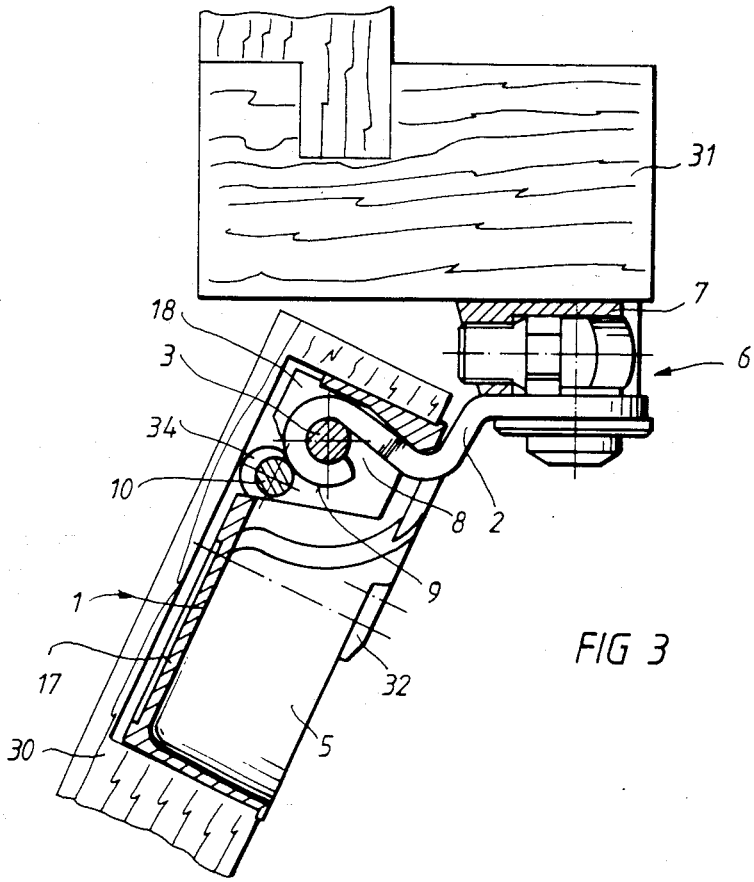
FIG. 3 is a sectional view through the lines III—III of FIG. 1, but with the door hinge in open position.

The hinge according to FIGS. 1 to 3 consists of a hinge pan 1, to which a hinge arm 2 is articulated. Hinge arm 2 is mounted on an axle 3 in the hinge pan 1, the axle engaging on both sides in seatings 4 within sidewalls 19. The sidewalls 19 define between them a recess 5, in which the hinge arm 2 engages, and is pivotable there.

The hinge pan 1 is inset in a recess (not shown) on the inside of a door 30, while the hinge arm 2 is secured through an attachment 6 adjustable in several directions by means of a fastening plate 7 on the inside of a body 31.

The end of hinge arm 2 placed around the axle 3 is curved in the form of a round section, the round section not looping the axle 3 entirely but leaving an opening 8. The curved part of hinge arm 2 together with the opening 8 forms a cam 9, for a roller 10 of the closing pressure device, which in a spring-loaded manner under the force of two springs 22 either rolls off in to the opening position on the round part of cam 9, or to the closing position and snaps into the opening 8. In the closing position, therefore, the hinge is held closed by engagement of roller 10 into the opening 8 of cam 9 under the force of the two springs 22.

The roller 10 executes a spring movement in the arrow directions 12.

FIG. 3 shows that for the application of the springs 22 the bottom 17 of the hinge pan 1 comprises a rear recess 18, in which the axle 3 is mounted in the hinge pan 1.

Figure 4:
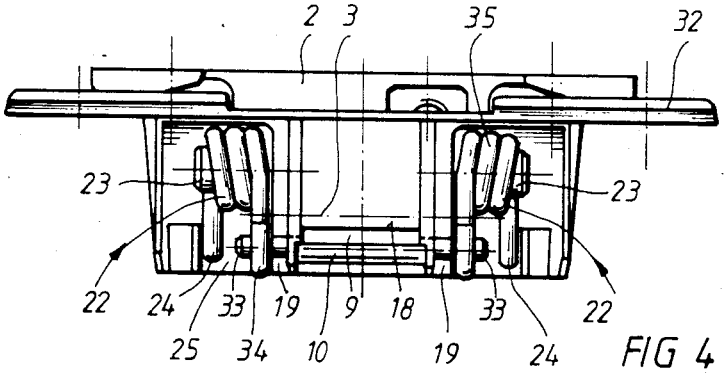
FIG. 4 is an end view of the hinge according to FIG. 1 and FIG. 3 in the closed state.
Figure 5:
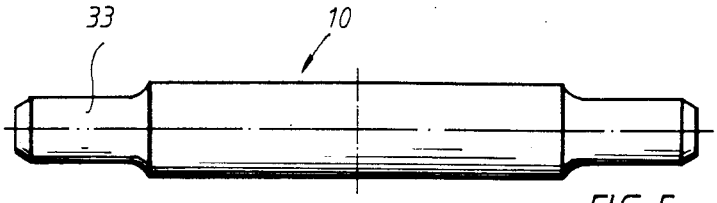
FIG. 5 is a side view of the roller.

In the region of this recess 18 there is disposed the roller 10, which according to FIG. 5 is connected with coaxial roller axles 33 integrally at the end faces. These roller axles 33 are embraced by the bent leg ends 34 of a spring 22 for each axle. The roller 10 as seen in FIG. 4 is therefore pressed under high spring force against the cam 9 of the bent end of hinge arm 2 in a direction perpendicular to the plane of the drawing. The respective other end 24 of each spring 22 braces against the external wall 25 of hinge pan 1.

Each spring 23 is supported by its spring turns 35 on a pin 23 for each spring, which is connected by its one end face with the hinge pan 1 in the region of the sidewall 19. The spring 22 is only slipped onto the outwardly protruding pin 23. This constitutes an especially simple attachment.

Figure 6:
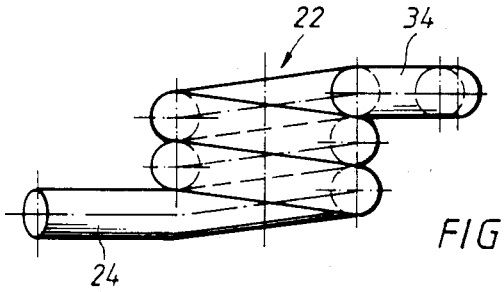
FIG. 6 is a top view of the spring.
Figure 7:
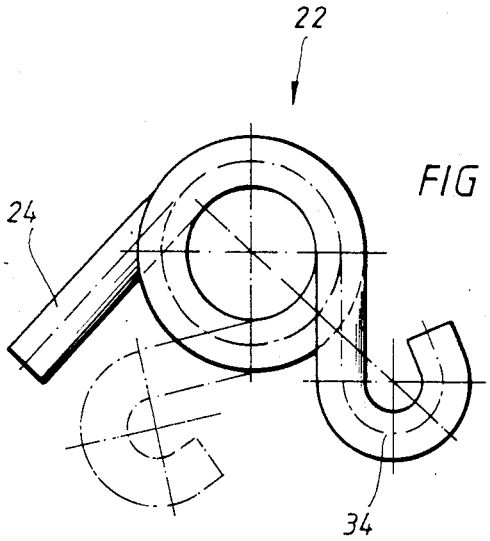
FIG. 7 is a side view of the spring in the loaded and unloaded state.

FIGS. 6 and 7 show respectively a spring 22 in plan view and in side view with FIG. 7 showing the spring in the loaded and unloaded state.

I claim:

1. In an improved single-joint door hinge with a closing pressure and optionally opening pressure device, having a hinge pan with a recess, opposite side walls containing seatings for an axle and an external abutment wall; and a hinge arm having a bent end embracing said axle, with an outer face of said bent end formed as a cam for a roller subjected to forces exerted by biasing means fastened in said hinge pan; wherein said improvement comprising two oppositely disposed multiply coiled torsionally stressed springs with each spring having a first and a second leg end forming said biasing means; and each of said torsionally stressed springs being supported at one end thereof by having the first leg and being braced against said external abutment wall of said hinge pan, and being supported at the other end thereof by the second leg and being bent around one end of said roller in the shape of a hook; said multiple coils of said torsionally stressed springs being slipped over and supported on coaxial pins axles, wherein said pin axles are connected to and extend outwardly from said opposite side walls for simplicity of assembly; and said roller, coaxial pin axles and said axle of said hinge arm all being oriented in a substantially parallel relationship, with said roller being maintained in place solely by the hook shaped bent second leg end of each said torsionally stressed springs, and whereby said torsionally stressed springs provide extremely strong closing pressure to said door hinge.

* * * * *